US006743010B2

(12) United States Patent
Bridgeman et al.

(10) Patent No.: US 6,743,010 B2
(45) Date of Patent: Jun. 1, 2004

(54) RELIGHTER CONTROL SYSTEM

(75) Inventors: Clyde G. Bridgeman, Peoria, IL (US); Christopher J. Wolcott, East Peoria, IL (US); Paul T. Woodnorth, Lansing, IL (US)

(73) Assignee: Gas Electronics, Inc., Peoria, IL (US)

( * ) Notice: Subject to any disclaimer, the term of this patent is extended or adjusted under 35 U.S.C. 154(b) by 151 days.

(21) Appl. No.: 10/078,646

(22) Filed: Feb. 19, 2002

(65) Prior Publication Data

US 2003/0157452 A1 Aug. 21, 2003

(51) Int. Cl.[7] ..... F23Q 9/00
(52) U.S. Cl. ..... 431/278; 431/254
(58) Field of Search ..... 431/18, 278, 75, 431/264, 266, 254

(56) References Cited

U.S. PATENT DOCUMENTS

| | | | | |
|---|---|---|---|---|
| 517,721 | A | | 4/1894 | Armbruster |
| 655,176 | A | | 8/1900 | Ackermann |
| 2,448,497 | A | | 8/1948 | Rosche |
| 2,564,596 | A | | 8/1951 | Dahline |
| 2,564,597 | A | | 8/1951 | Dahline |
| 2,577,787 | A | | 12/1951 | Mayer et al. |
| 2,579,884 | A | | 12/1951 | Thomson et al. |
| 2,622,669 | A | | 12/1952 | Caracristi et al. |
| 2,664,234 | A | | 12/1953 | Burger |
| 2,666,480 | A | | 1/1954 | Peterson |
| 2,864,234 | A | | 12/1958 | Seglem et al. |
| 3,236,284 | A | | 2/1966 | Kemper |
| 3,261,008 | A | | 7/1966 | Schreter et al. |
| 3,302,685 | A | | 2/1967 | Ono et al. |
| 3,327,758 | A | | 6/1967 | Cleall |
| 3,529,584 | A | | 9/1970 | Celaya |
| 3,620,658 | A | | 11/1971 | Tappin |
| 3,701,137 | A | | 10/1972 | Hulsman |
| 3,902,839 | A | * | 9/1975 | Matthews |
| 3,906,221 | A | * | 9/1975 | Mercier |
| 3,915,625 | A | | 10/1975 | Hapgood |
| 4,147,494 | A | | 4/1979 | Ando et al. |
| 4,168,141 | A | * | 9/1979 | Saito |
| 4,298,336 | A | | 11/1981 | Riehl |
| 4,311,452 | A | | 1/1982 | Begin |
| 4,346,055 | A | | 8/1982 | Murphy et al. |
| 4,391,582 | A | | 7/1983 | Cowan |
| 4,427,363 | A | | 1/1984 | Hammond |
| 4,431,400 | A | | 2/1984 | Kobayashi et al. |
| 4,519,771 | A | | 5/1985 | Six et al. |
| 4,541,798 | A | | 9/1985 | Miller et al. |
| 4,552,528 | A | | 11/1985 | Gaiffier |
| 4,561,839 | A | | 12/1985 | Neumann |
| 4,595,354 | A | | 6/1986 | Guerra |
| 4,629,414 | A | | 12/1986 | Buschulte et al. |
| 4,662,838 | A | | 5/1987 | Riordan |
| 4,711,629 | A | | 12/1987 | MacDonald |

(List continued on next page.)

*Primary Examiner*—Alfred Basichas
(74) *Attorney, Agent, or Firm*—Wallenstein Wagner & Rockey, Ltd.

(57) ABSTRACT

A relighter apparatus for operating a pilot burner for a fuel pipeline heater. The relighter apparatus has a controller located at a first location, and a pilot burner assembly and ignition coil located at a second location which is remotely located a distance from the first location. The ignition coil is also electrically connected to the controller. The ignition coil receives a low voltage input based on a signal from the controller and provides a high voltage output at the output thereof. Current corresponding to the high voltage output is transferred from the ignitor coil, through a terminal and to an ignitor rod. A conduction of the electrical current between the second end of the ignitor rod and the pilot burner assembly causes an adequate spark to ignite the air/fuel mixture in the pilot burner assembly, creating a pilot flame.

24 Claims, 2 Drawing Sheets

U.S. PATENT DOCUMENTS 4,871,307 A 10/1989 Harris et al.
4,891,004 A 1/1990 Ballard et al.
4,915,614 A 4/1990 Geary
4,946,384 A 8/1990 London
4,972,152 A 11/1990 Finn
4,976,605 A 12/1990 Geary
5,020,988 A 6/1991 Peterson
5,055,825 A 10/1991 Yang
5,073,104 A 12/1991 Kemlo
5,085,040 A 2/1992 Tilston
5,106,293 A 4/1992 Hawkins
5,203,687 A 4/1993 Oguchi
5,222,889 A 6/1993 Hsu
5,267,849 A 12/1993 Paciorek
5,360,335 A 11/1994 Anderson et al.
5,364,260 A 11/1994 Moore
5,368,471 A 11/1994 Kychakoff et al.
5,372,497 A 12/1994 Coolidge et al.
5,425,631 A 6/1995 Krueger et al.
5,429,496 A 7/1995 Stephens et al.
5,432,095 A 7/1995 Forsberg
5,433,117 A 7/1995 Taphorn et al.
5,433,601 A 7/1995 Buschulte et al.
5,435,717 A 7/1995 Bohan, Jr. et al.
5,439,374 A 8/1995 Jamieson
5,453,002 A 9/1995 Scott
5,460,515 A 10/1995 Harbeck et al.
5,468,142 A 11/1995 Koziol
5,472,336 A 12/1995 Adams et al.
5,472,337 A 12/1995 Guerra
5,472,340 A 12/1995 Lynch
5,478,232 A 12/1995 Dillinger et al.
5,503,540 A 4/1996 Kim
5,506,569 A 4/1996 Rowlette
5,531,584 A 7/1996 Jacques
5,534,781 A 7/1996 Lee et al.
5,538,416 A 7/1996 Peterson et al.
5,557,050 A 9/1996 Campain et al.
5,571,007 A 11/1996 Ishiguro et al.
5,577,905 A 11/1996 Momber et al.
5,599,180 A 2/1997 Peters et al.
5,607,294 A 3/1997 Gianpiero et al.
5,616,022 A 4/1997 Moran, IV
5,617,721 A 4/1997 Slawson
5,622,200 A 4/1997 Schulze
5,636,978 A 6/1997 Sasaki
5,927,963 A 7/1999 Wolcott et al.
6,089,856 A 7/2000 Wolcott et al.

* cited by examiner

RELIGHTER CONTROL SYSTEM

DESCRIPTION

1. Technical Field

The present invention relates generally to gas burner pilot assemblies and control systems for gas burners ignited by a pilot flame, and more specifically to relighter system for a gas burner pilot assembly used with fuel pipeline heaters.

2. Background Prior Art

A specialized type of heater apparatus is necessary for use on fuel pipelines, including natural gas pipelines. With natural gas fuel pipelines, the need for such heaters arises to prohibit the condensation of hydrocarbons in the pipelines. When there is a reduction in the pressure of the natural gas within the pipeline, such as is typically the case when a percentage of the gas in a main line is diverted to a separate pipeline to service a municipality or the like, the sudden loss in internal pipeline pressure may result in the development of undesirable condensation of hydrocarbons in the pipeline. The development of hydrocarbon condensation may lead to an obstruction or faulty flow of gas. This possible hydrocarbon condensation problem may be avoided by heating the pipeline.

Many gas burning heaters in use today often include a manually operated pilot flame ignition. These manually operated pilot flame ignitions are often provided without safety features such as reliable relighting of an extinguished pilot or main burner shut-off features. Further, many of the gas heaters presently being used are not reliable for preventing hydrocarbon condensation in the pipeline because they do not have safety features for detecting and reacting to pilot-burner flame failure. Further, because many of the heaters presently in use do not have reliable relighting features, they often require continual pilot flames even though the actual burner is used infrequently. The use of continual pilot flames, however, results in wasted fuel and unnecessary pilot burn time, thereby increasing the cost and decreasing the overall life of the burner components.

Additionally, other relighting systems presently in use in the industry have a pilot assembly with a structure having an ignitor terminal extending into the pilot flame. This often results in the deterioration of the ignitor terminal due to constant exposure in the pilot flame and/or loss of the important tolerance of the spacing of the ignitor terminal.

Many of these noted disadvantages have been overcome by U.S. Pat. No. 6,089,856, entitled "Pilot Control Assembly," and U.S. Pat. No. 5,927,963, a divisional of the '856 patent. Both of these U.S. patents are commonly owned by the assignee of the present invention, and are hereby incorporated by reference herein. The inventions of the '856 and '963 patents resolved many of the above noted disadvantages, primarily by providing a specific structure of a pilot assembly, and by providing a pilot control means which optionally provides a continuous burning pilot or provides an on-demand pilot, both such pilot operations having safety features for shutting down the main burner valve and relighting the pilot, in the event the pilot is extinguished.

Notwithstanding the benefits of the '856 and '963 patents, the system configuration of many gas burner heaters utilizing pilot control means and pilot ignition devices may have certain drawbacks. Often, the burner control system in the prior art devices includes a control system. The control system in prior art devices included a control board with an ignitor coil. The ignitor coil receives a low voltage input (approximately 150–200 volts) and develops a high voltage charge (approximately 15,000 to 25,000 volts). Typically, a terminal is connected to the output of the ignitor coil, and a high voltage wire is connected from the terminal to the ignitor rod. Because of hysteresis, the maximum distance allowable between the ignitor coil and the ignitor rod is approximately 10 ft. At distances greater than 10 feet between the ignitor coil and the ignitor rod, the high voltage and low impedance charge from the ignitor coil becomes unreliable. An unreliable charge may not provide a spark at the ignitor rod tip, thus resulting in unreliable relighting, and the potential formation of hydrocarbon condensation due to the temperature drop from the line heater being down. As a result, prior art control boards and ignitor coils were connected to ignitor rods with a high voltage wire at a span of less than approximately 10 ft.

Additionally, because the high voltage charge created by the ignitor coil, and the proximity of this charge to a lit gas supply, it is often necessary to place the control system and ignitor coil in an explosion proof container. By placing the control system and ignitor coil in a sealed chamber or cabinet, and often an explosion proof container, it is thought that in the event of a gas leak, a potential fire hazard through ignition of any leaked gas may be avoided. Such containers, however, are extremely expensive.

Accordingly, there is a need for a reliable and effective relighter system for a burner control system used with fuel pipeline heaters.

SUMMARY OF THE INVENTION

The present invention provides a system for providing a spark to a pilot burner for a heater for a fuel pipeline. The system generally includes a controller, a pilot burner and an ignition coil. The controller is located at a first location, and the pilot burner is located at a second location remote from the first location. Additionally, the ignition coil is also located at the second location. Typically, the ignition coil is electrically connected to the controller and it receives a voltage input from the controller. After receiving the voltage input, the ignition coil charges until it subsequently provides a voltage output. The ignition coil transfers a current based on the voltage output to create a spark in the pilot burner to ignite an air/fuel mixture in the pilot burner.

According to one aspect of the present invention, a low voltage line connects the controller and the ignition coil. In one embodiment, the first location is located a distance of approximately at least 10 feet from the second location. Additionally, the first location may be located a distance of approximately between 10 feet and 100 feet from the second location. Finally, the first location may be located a distance of at least 100 feet from the second location.

According to another aspect of the present invention, the voltage input the ignition coil receives from the controller is a low voltage input, and the voltage output of the ignition coil is a high voltage output. Generally, the low voltage input received from by the ignition coil is in the range of approximately 10 volts to approximately 200 volts.

According to another aspect of the present invention, an ignitor module is located at the second location and adjacent the pilot burner assembly. The ignitor module has a housing with the ignitor coil and a transformer therein. The transformer is electrically connected to the ignition coil. The transformer receives a first low voltage input from the controller and converts the first low voltage input to a second low voltage input. Typically, the second low voltage input is of a higher voltage than the first low voltage input. The second low voltage input is transferred from the transformer to the ignition coil. In one embodiment, the first low voltage input is approximately 12 volts, and the resulting second low voltage input is approximately 150–200 volts.

According to another aspect of the present invention, the ignitor coil and transformer are potted in the ignitor module housing in a thermoplastic resin. Additionally, the ignitor module also has a terminal strip electrically connected to the transformer and the ignitor coil, and a terminal extending from the ignitor coil and through a wall in the housing.

According to yet another aspect of the present invention, an ignitor rod is provided. The ignitor rod has a first end electrically connected to a terminal at an exit of the ignitor coil, and a second end adjacent the pilot burner. Current corresponding to the high voltage output is transferred from the ignitor coil to the ignitor rod. Conduction of the electrical current between the second end of the ignitor rod and the pilot burner causes a spark to ignite the air/fuel mixture in the pilot burner, thereby creating a pilot flame.

Other features and advantages of the invention will be apparent from the following specification taken in conjunction with the following drawings.

BRIEF DESCRIPTION OF THE DRAWING

To understand the present invention, it will now be described by way of example, with reference to the accompanying drawings in which.

DETAILED DESCRIPTION OF THE INVENTION

Figure 1:
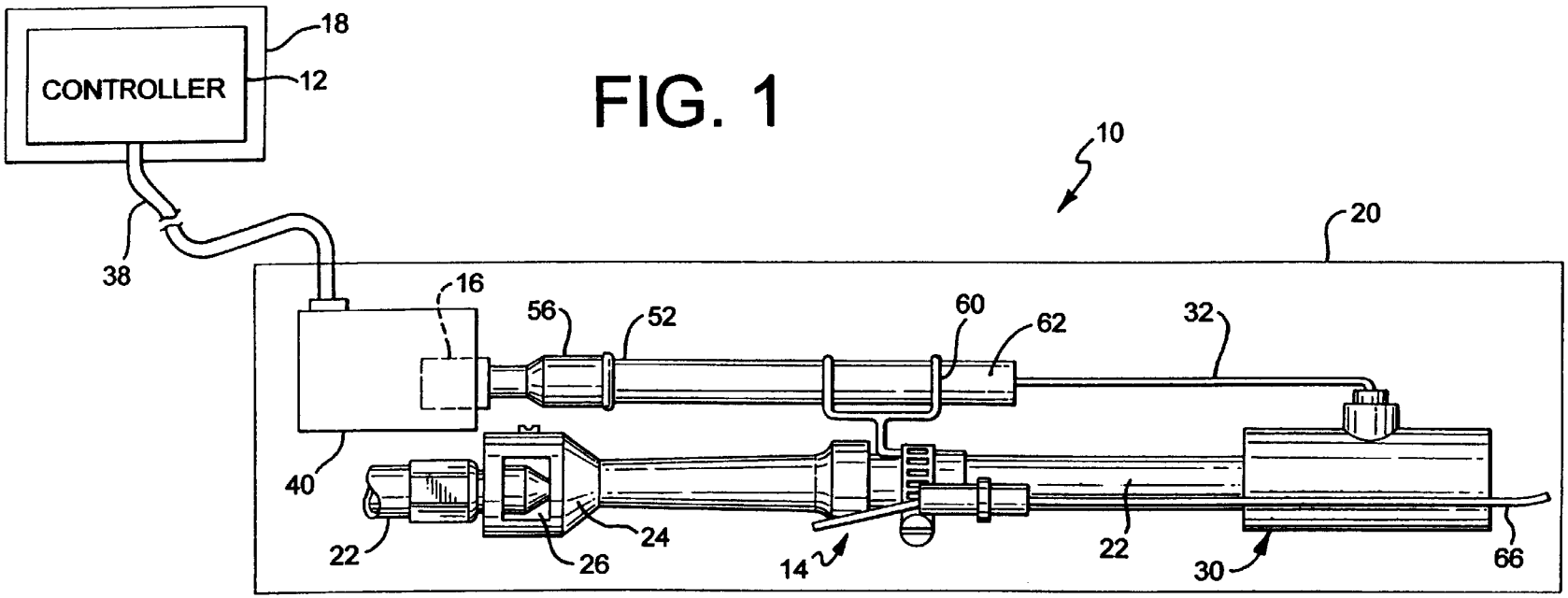
FIG. 1 is a side elevation view of the relighter apparatus of the present invention.

While this invention is susceptible of embodiments in many different forms, there are shown in the drawings and will herein be described in detail, preferred embodiments of the invention with the understanding that the present disclosures are to be considered as exemplifications of the principles of the invention and are not intended to limit the broad aspects of the invention to the embodiments illustrated.

Figure 2:
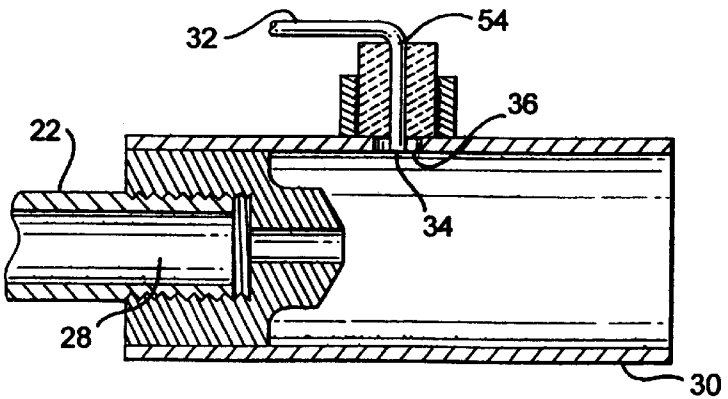
FIG. 2 is a side sectional view of the spark area of the present invention.
Figure 4:
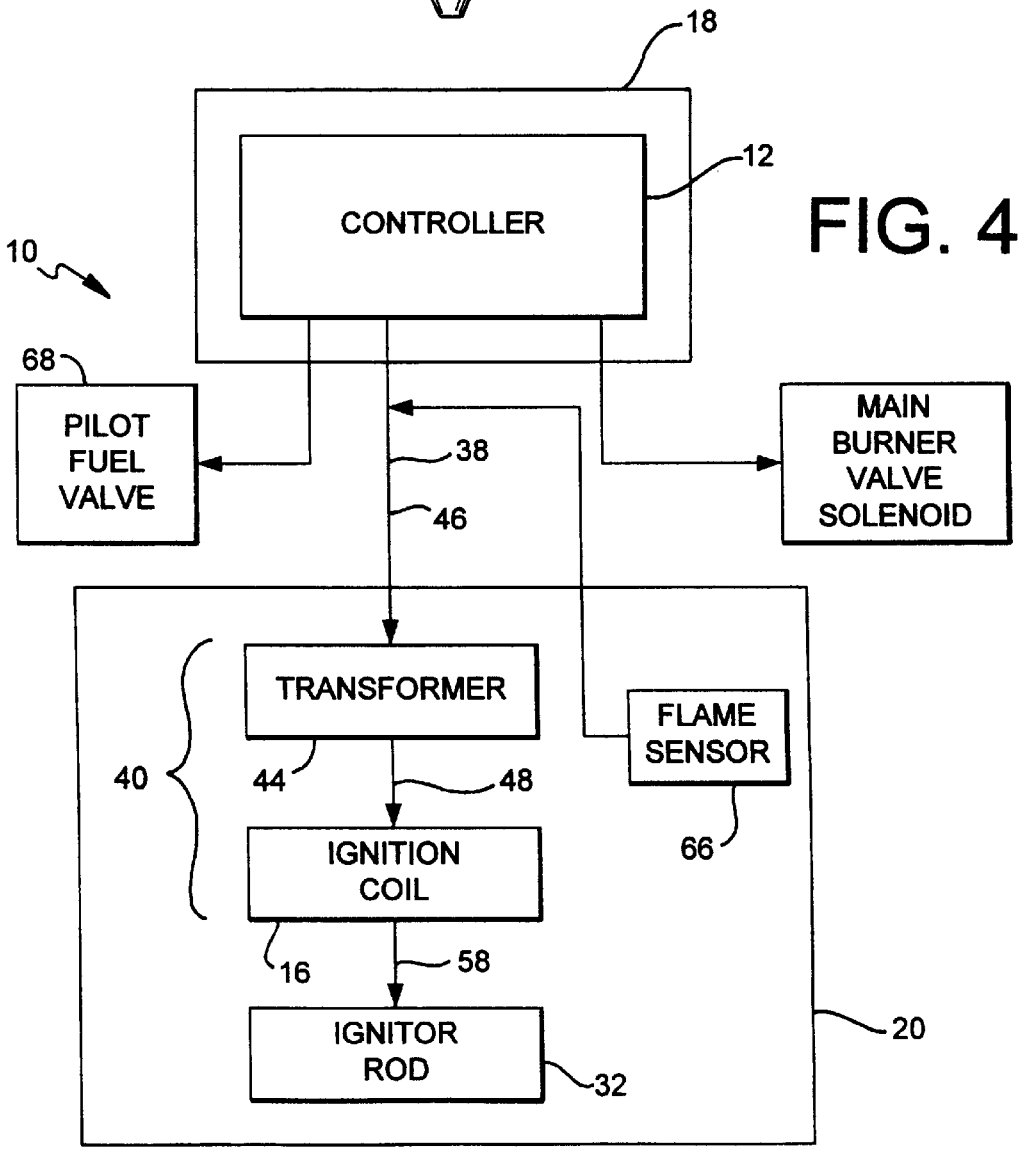

Referring now in detail to the Figures, and initially to FIG. 1, there is shown a pilot assembly including a relighter system 10 for providing a spark to a pilot burner for a heater for a fuel as constructed in accordance with the teachings of the present invention. Typically, the system 10 generally includes a controller 12, a pilot burner 14 and an ignition coil 16. One type of ignition coil 16 is a spark transformer. The controller 12 is located at a first location 18, and the pilot burner 14 and ignition coil 16 are located at a second location 20 separate from and remote from the first location 18. One embodiment of the pilot burner 14 is shown in FIGS. 1 and 2, however it is understood that the relighter system 10 of the present invention is applicable with other controllers 12 and pilot burners 14. Additionally, one type of controller 12 includes a control means whereby the control means sends a signal, typically a low voltage signal across an electrical current supply line 38 which is generally a low voltage line, to the ignition coil or spark transformer. As shown in FIG. 4, the control means 12 or controller 12 may have computer data operation adapted to receive a signal to ignite the pilot burner and to respond by providing an electrical control to open a gas valve solenoid and also to provide a low voltage signal to the spark transformer. Such operation of the controller is fully explained in U.S. Pat. No. 6,089,856, which is incorporated herein by reference.

Typically, the pilot burner assembly 14 receives a fuel supply which is provided by a pilot fluid supply pipe 22. The pilot fluid supply pipe 22 is adapted to provide a flow of combustible gaseous fuel therethrough. The fluid supply pipe 22 has a venturi means 24 with at least one opening 26 to expose air to the pipe 22 and to provide for mixing the air with the fuel passing therethrough. As such, the distal end 28 of the fluid supply pipe 22 delivers a gas/air mixture as the pilot fuel to the pilot burner.

A pilot burner head 30 of the pilot burner assembly 14 receives the gas/fuel mixture from the fluid supply pipe 22. The pilot burner head 30 also receives the ignitor rod 32, and provides a surface 36 adjacent the tip 34 of the ignitor rod 32 to provide for conduction of electrical current between those two elements to develop an adequate spark to ignite the gas/fuel mixture and create the pilot flame. The ignitor rod 32 is held in place with an ignitor brace 60 which is mounted to the pilot fluid supply pipe 22 and is attached to the ignitor rod 32 through a brace insulator sleeve 62.

In the prior art, the electrical current for conduction was provided by an ignitor coil located adjacent the controller. The ignitor coil adjacent the controller received a low voltage input and developed a high voltage charge. A high voltage cable was connected from the ignitor coil, adjacent the controller, to the ignitor rod adjacent the pilot burner assembly. Because of hysteresis, the controller and ignitor coil in the prior art were located at a maximum distance of no more than approximately 10 ft. As such, the controller and the pilot burner assembly were proximally positioned at the same location.

Conversely, in the relighter system of the present invention, the controller 12 or control means 12 and the pilot burner assembly 14 are positioned completely separate, and at distinct and remote locations. Similarly, the ignition coil 16 of the present invention is located completely separate and distal from the location of the control means 12. Further, the ignition coil 16 in the present invention is positioned at the same general location as the pilot burner assembly 14, as opposed to being adjacent the controller as in the prior art.

As shown in FIGS. 1 and 4 of the present invention, a system 10 is furnished to provide a spark to a pilot burner assembly 14 for igniting a fuel mixture in a fuel pipeline heater. The system 10 includes the controller 12 being located in the first location 18. The pilot burner 14 is located at the second location 20 which is remote from the first location 18. In terms of being located in a remote location, what is meant is that the first location 18 is positioned at a distance from the second location 20 which is greater than what previously was not allowable because of hysteresis during the transfer of a high voltage from the ignitor coil to the ignitor rod. This distance between the first location 18 and the second location 20 is typically greater than 10 feet, and may be preferably at least 25 feet. Similarly, what is meant by being located at the same location is that the members are located at relative location with a relative distance that is typically known as being the maximum allowable to prevent the development of hysteresis (i.e., within approximately 10 feet).

Additionally, in the preferred embodiment of the present invention the ignition coil 16 is also located at the second location 20, remote from the first location 18, and adjacent the pilot burner 14. In the preferred embodiment, the ignition coil 16 is electrically connected to the controller 12 with a low voltage line 38. When using a low voltage line 38, the controller 12 may be located a distance of up to 100 feet from the ignition coil 14. In other embodiments, the controller 12 at the first location 18 may be located a distance of greater than 100 feet from the ignition coil 14 at the second location 20. As appropriate, the controller 12 provides a signal to the ignition coil 16 through the low voltage line 38. In the preferred embodiment, the signal provided to the ignition coil 16 from the controller 12 will be a low voltage signal. In such a configuration, the ignition coil 16 receives the signal as a low voltage input, and correspondingly develops a high voltage output 58. The ignition coil 16 transfers a current based on its high voltage output to create a spark in the pilot burner 14 to ignite the air/fuel mixture in the pilot burner 14. In the preferred embodiment, while the voltage input received by the ignition coil 16 is a low voltage input, the voltage output developed by the ignition coil 16 is a high voltage output 58 which is necessary to create the spark in the pilot burner 14.

Figure 3:
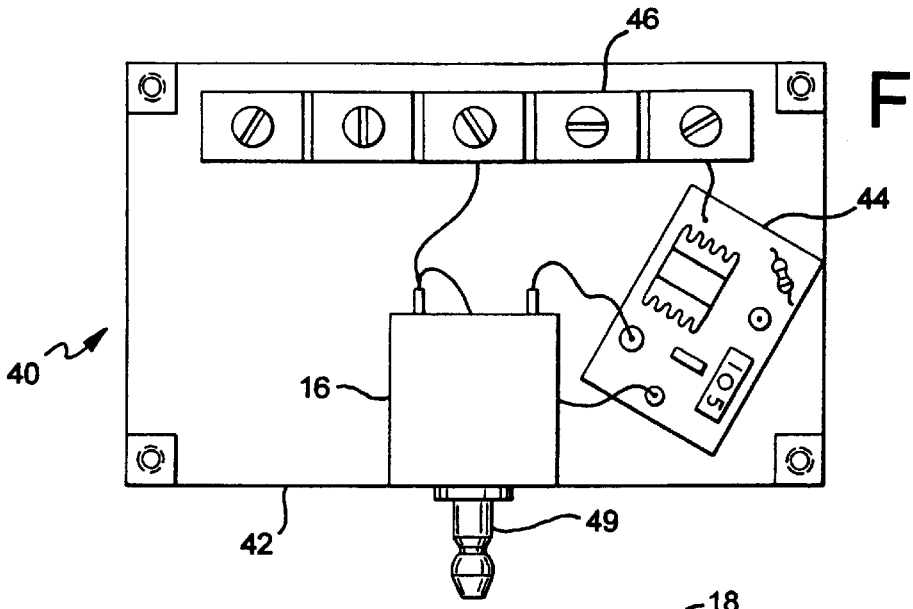
FIG. 3 is a top plan view of the ignitor module of the present invention; and, FIG. 4 is a block diagram of the control system and relighter apparatus of the present invention.

As shown in FIGS. 1 and 3, the ignition coil 16 may be part of a ignitor module 40. The ignitor module 40 is located at the second location 20 and adjacent the pilot burner assembly 14. The ignitor module 40 comprises a housing 42, with the ignition coil 16 and a transformer 44 located therein. The ignitor module 40 also has a terminal strip 46 for electrical connection therewith. In one embodiment, three of the connections on the terminal strip 46 are provided for electrical connection with the wire 38 extending from the controller 12, including: an input for connection with the primary coil of the ignitor coil 16 at the first terminal location, an input for ground at the second terminal location, and an input from the controller for connection with the flame sensor 66 in the fourth terminal location. The third slot or terminal location on the terminal strip 46 is for a connection to a ground located on the venturi, and the fifth slot on the terminal strip 46 is for electrical connection directly with the flame sensor 66. Typically, the input for the flame sensor 66 (at the fourth slot) and the fifth slot for connection with the flame sensor are electrically connected. The ignitor coil 16 and transformer 44 in the ignitor module 40 are potted in the housing 42 in a high temperature thermoplastic resin, which may be a phenol. A terminal 49 extends from the output of the ignition coil 16 and through a hole in a wall of the housing 42. In one embodiment, the transformer 44 receives a first low voltage 46 input from the controller through the low voltage line 38. The first low voltage input 46 is approximately 12 volts, however, one of ordinary skill in the art understands that any low voltage input, including, but not limited to approximately 12 volts, is acceptable. The low voltage input may be as low as approximately 9 to 10 volts, but preferably at least 12 volts, to approximately 150–200 volts, but typically less than approximately 220 volts. However, greater voltages may be possible as the low voltage input. The transformer 44 subsequently converts the first low voltage input 46 to a second low voltage input 48, and the second low voltage input 48 is transferred from the transformer 44 to the ignition coil 16. Typically, the second low voltage input 48 is generally of a higher voltage than the first low voltage input 46. In one embodiment, the resulting second low voltage input 48 is approximately 150–200 volts, stepped up from the first low voltage input 46 of 12 volts.

The ignition coil 16 receives the second low voltage input 48 from the transformer 44. The incoming second low voltage input 48 passes through a primary winding circuit (not shown) and a secondary winding circuit (not shown) in the ignition coil 16 that raises the power to a high voltage output of about 15,000 to 25,000 volts. As is understood by one of ordinary skill in the art, the primary winding circuit typically contains numerous turns of a heavier wire, typically copper, that are insulated from each other. The primary circuit wire goes into the ignition coil 16 through a positive terminal and exits through the negative terminal. The secondary winding circuit typically contains numerous turns, typically more than the primary winding, of a finer copper wire, which are also generally insulated from each other. To further increase the coils magnetic field, both windings may be installed around a soft iron core. As the current from the second low voltage input 48 flows through the coil, a strong magnetic field is built up. Then, when the current is shut off, the collapse of the magnetic field induces a high voltage in the secondary circuit that is released through the center terminal, which in one embodiment is a terminal 49 as shown in FIGS. 1 and 3. In general, the low voltage input passes through the primary circuit, which induces a high voltage in the secondary circuit, which is then directed to the terminal 49 and the ignitor rod 32 electrically connected to the terminal 49. The purpose of the ignition coil 16 is to create a voltage high enough (typically at least 15,000 volts) to arc-cross the gap between the tip 34 of the ignitor rod 32 and the pilot burner 14, thus creating a spark strong enough to ignite the air/fuel mixture for combustion.

As best shown in FIG. 1, the ignitor rod 32 has a first end 52 that is electrically connected to the terminal 49 at an exit of the ignition coil 16. The ignitor rod 32 also has a second end 54 (shown in FIG. 2), typically having a tip 34, that is adjacent the pilot burner 14. The first end 52 of the ignitor rod 32 is connected to the terminal 49 with a mating connector (not shown). In a preferred embodiment, a joy plug at the first end 52 of the ignitor rod 32 connects the ignitor rod 32 to the terminal 49. An insulating sleeve 56, preferably a silicon boot, is placed over the terminal 49 and the first end 52 of the ignitor rod 32 to provide electrical insulation for those components and for the current passing therethrough.

Thus, the current corresponding to the high voltage output 58 is transferred from the ignitor coil 16, through the terminal 49 and to the ignitor rod 32. Further, as shown in FIGS. 2 and 4, the electrical current corresponding to the high voltage output 58 that is transferred through the ignitor rod 32 conducts at the tip 34 thereof with the pilot burner 14 to cause an adequate spark to ignite the air/fuel mixture in the pilot burner 14, creating the pilot flame.

In one embodiment, as shown in U.S. Pat. No. 6,089,856, and partially schematically illustrated in FIG. 4 hereto, a flame sensor 66 may be provided to indicate the presence/absence of a pilot flame to the computerized control means 12 which is connected to the sensor 66 by a wire. When the flame sensor 66 indicates that a pilot flame is not present, the control means controls the ignitor rod 32 by providing current to the ignitor module 40 to initiate a spark at the ignitor tip between the tip and the pilot burner wall. The computerized control means is also electrically connected to a pilot fuel supply valve 68 which is in fluid communication with the pilot supply pipe 22. The control means 12 controls the pilot valve and main valve to open the valves with electrical current, and also maintains the main valve open with electrical current of decreased voltage when the pilot flame sensor 66 senses the pilot flame and provides an indication of the same.

It will be understood that the invention may be embodied in other specific forms without departing from the spirit or central characteristics thereof. The present embodiments, therefore, are to be considered in all respects as illustrative and not restrictive, and the invention is not to be limited to the details given herein.

What is claimed is:

1. A system for providing a spark to a pilot burner for a heater for a fuel pipeline, comprising:

a controller located at a first location;

a pilot burner located at a second location remote from the first location; and, an ignition coil located at the second location, the ignition coil further being electrically connected to the controller, wherein the ignition coil receives a voltage input from the controller and provides a voltage output, and wherein the ignition coil transfers a current based on the voltage output to create a spark in the pilot burner to ignite an air/fuel mixture in the pilot burner.

2. The system of claim 1, wherein the voltage input the ignition coil receives from the controller is a low voltage input, and wherein the voltage output of the ignition coil is a high voltage output.

3. The system of claim 2, wherein the low voltage input received by the ignition coil is in the range of approximately 9 volts to approximately 200 volts.

4. The system of claim 1, further comprising a transformer electrically connected to the ignition coil, the transformer receiving a first low voltage input from the controller and converting the first low voltage input to a second low voltage input, the second low voltage input being of a higher voltage that the first low voltage input, and the second low voltage input being transferred from the transformer to the ignition coil.

5. The system of claim 4, wherein the first low voltage input is approximately 12 volts, and wherein the resulting second low voltage input is approximately 150–200 volts.

6. The system of claim 1, wherein the first location is located a distance of approximately at least 10 feet from the second location.

7. The system of claim 1, wherein the first location is located a distance of approximately between 10 feet and 100 feet from the second location.

8. The system of claim 1, wherein the first location is located at distance of at least 100 feet from the second location.

9. The system of claim 1, further comprising a low voltage line connecting the controller and the ignition coil.

10. The system of claim 2, further comprising an ignitor rod having a first end electrically connected to a terminal at an exit of the ignitor coil, and a second end of the ignitor rod adjacent the pilot burner, wherein the current corresponding to the high voltage output is transferred from the ignitor coil, through the terminal, to the ignitor rod, and wherein a conduction of the electrical current between the second end of the ignitor rod and the pilot burner causes an adequate spark to ignite the air/fuel mixture in the pilot burner, creating a pilot flame.

11. A relighter apparatus for operating a pilot burner for fuel pipeline heater, comprising:

a controller located at a first location;

a pilot burner assembly located at a second location, the second location being remotely located a distance from the first location;

an ignition coil located at the second location and adjacent the pilot burner assembly, the ignition coil being electrically connected to the controller and having an output at one end thereof, wherein the ignition coil receives a low voltage input based on a signal from the controller and provides a high voltage output at the output thereof; and, an ignitor rod connected to the output of the ignition coil, the ignitor rod having a second end thereof adjacent the pilot burner assembly, wherein an electrical current corresponding to the high voltage output is transferred from the ignitor coil to the ignitor rod, and wherein a conduction of the electrical current between the second end of the ignitor rod and the pilot burner assembly causes an adequate spark to ignite the air/fuel mixture in the pilot burner assembly, creating a pilot flame.

12. The relighter apparatus of claim 11, further comprising an ignitor module located at the second location and adjacent the pilot burner assembly, the ignitor module having a housing with the ignitor coil and a transformer therein, the ignitor coil and transformer being potted in the housing in a thermoplastic resin, the ignitor module further having a terminal strip electrically connected to the transformer and the coil, and a terminal extending from the ignitor coil and through a wall in the housing.

13. The relighter apparatus of claim 11, wherein a first end of the ignitor rod has a mating member to connect the ignitor rod to the terminal, and wherein an insulating sleeve is positioned around the connection of the mating member and the terminal.

14. The relighter apparatus of claim 11, wherein the distance between the first location and the second location is at least 10 feet.

15. The relighter apparatus of claim 11, wherein the distance between the first location and the second location is at least 25 feet.

16. The relighter apparatus of claim 11, wherein the low voltage input received by the ignitor coil is less than approximately 220 volts.

17. The relighter apparatus of claim 12, further comprising a low voltage line connecting the controller with the ignitor module.

18. A system for operating a pilot burner for a fuel pipeline heater, comprising:

a control means, a spark transformer, and an electrical current supply line extending from the control means to the spark transformer, wherein the control means is positioned at a separated distance from the spark transformer, and wherein the control means is adapted to provide an electrical signal to the spark transformer through the electrical current supply line; and, a pilot burner assembly positioned separate of the control means and located proximal the spark transformer, the pilot burner assembly being in fluid communication with a gaseous fuel supply, the pilot burner assembly having a pilot flame head with a selectively energized spark tip, the spark tip being electrically connected to the spark transformer to receive a high voltage signal from the spark transformer to ignite a supply of the gaseous fuel.

19. The system of claim 18, wherein the electrical current supply line extending from the control means to the spark transformer is a low voltage line.

20. The system of claim 18, wherein the spark tip is electrically connected to the spark transformer with an ignitor rod.

21. The system of claim 18, wherein the spark transformer is potted in a phenol resin.

22. The system of claim 18, wherein the control means and the spark transformer are positioned at a distance of at least 10 feet.

23. The system of claim 18, wherein the control means has computer data operation adapted to receive a signal to ignite the pilot burner and responds by providing an electrical control to open a gas solenoid valve and by providing a low voltage signal to the spark transformer.

24. A system for providing a spark to a pilot burner for a heater for a fuel pipeline, comprising:

a controller, a pilot burner and an ignition coil, wherein the pilot burner is located proximal the ignition coil, and the controller is located distal the pilot burner and the ignition coil, wherein the ignition coil is electrically connected to the controller and the ignition coil receives a voltage input from the controller and provides a voltage output, and wherein the ignition coil transfers a current based on the voltage output to an ignitor member to create a spark in the pilot burner to ignite an air/fuel mixture in the pilot burner.

* * * * *